United States Patent [19]

Udall

[11] Patent Number: 4,515,294

[45] Date of Patent: May 7, 1985

[54] LIQUID DISPENSER, VALVE THEREFOR AND PROCESS OF PRODUCING THE VALVE

[75] Inventor: Raymond E. Udall, Atlanta, Ga.

[73] Assignee: Southern Chemical Products Company, Macon, Ga.

[21] Appl. No.: 363,966

[22] Filed: Mar. 31, 1982

[51] Int. Cl.[3] ..... B65D 35/56

[52] U.S. Cl. ..... 222/105; 222/183; 222/207; 222/214

[58] Field of Search ..... 222/92, 105, 107, 173, 222/180, 181, 183, 185, 206, 207, 211, 212, 213, 464, 476, 425, 444, 448; 137/515, 515.5; 251/148, 152

[56] References Cited

U.S. PATENT DOCUMENTS

| | | | |
|---|---|---|---|
| 398,111 | 2/1889 | Abbot et al. | 137/515 |
| 2,212,582 | 8/1940 | Bellah | 222/207 |
| 2,622,539 | 12/1952 | Martin | 222/181 X |
| 2,979,234 | 4/1961 | Kamborian | 222/146.5 |
| 3,100,587 | 8/1963 | Cox, Jr. | 222/105 |
| 3,204,825 | 9/1965 | Underwood | 222/105 |
| 4,256,242 | 3/1981 | Christine | 222/207 |
| 4,349,133 | 9/1982 | Christine | 222/183 |
| 4,381,846 | 5/1983 | Heck | 222/105 |
| 4,421,253 | 12/1983 | Croley | 222/105 |

*Primary Examiner*—Joseph J. Rolla

*Assistant Examiner*—Michael S. Huppert

*Attorney, Agent, or Firm*—Newton, Hopkins & Ormsby

[57] ABSTRACT

A main housing assembly has a back plate and a front casing which is hingedly secured to the back plate. A bracket on the backplate supports a liquid reservoir which includes a flexible bag carried by a fiber board box, the bag having a discharge tube clamped at one corner of the bag. A discharge nozzle assembly is connected by one end to the discharge tube, the discharge nozzle assembly having a pair of ball check valves carried by the ends of a flexible tube. The lower ball check valve protrudes from the bottom of the housing when the liquid reservoir is mounted on the bracket and the nozzle assembly protrudes downwardly therefrom in front of the bracket. A depressible plunger carried by the casing is adapted to squeeze the flexible tube of the nozzle assembly so as to close the upper ball check valve and open the lower ball check valve permitting a metered amount of liquid to be discharged through the lower ball check valve. The method of forming the liquid reservoir includes enclosing the bag in the fiber board housing and then inverting the liquid reservoir assembly so as to insert the liquid through the discharge tube which protrudes through the housing. A cap is then placed on the end of the discharge nozzle so that the liquid reservoir assembly can be shipped.

9 Claims, 11 Drawing Figures

LIQUID DISPENSER, VALVE THEREFOR AND PROCESS OF PRODUCING THE VALVE

BACKGROUND OF THE INVENTION

1. Field of the Invention

This invention relates to a liquid dispenser and is more particularly concerned with a liquid dispenser for dispensing soap, a liquid reservoir therefor, a valve assembly for the liquid dispenser and a process of producing the valve assembly and the liquid reservoir.

2. Description of the Prior Art

Liquid dispensers of the general type here disclosed have been extensively used before. One such liquid dispenser is known by the trademark SANI-FRESH. This prior art device includes a main housing assembly formed by a rear molded plastic member and front casing. Liquid soap is contained in a plastic bag in the upper end of the housing assembly and a nozzle assembly is permanently affixed to a bag contained within a fiberboard housing. This tube has an injection molded nozzle tip within which is a spring loaded check valve. The nozzle assembly has a depressable tube mounted adjacent to a platen on the inner surface of the forward housing so that an angularly squeeze plate disposed platen which is moved forwardly by a lever can pinch off a portion of the tube and then progressively apply pressure as a lever is brought forward for discharging the liquid which is pinched off in the tube. When the liquid soap is to be replenished, both the nozzle and the housing must be replaced. The nozzle tends to leak and the prior art device is quite complex, being formed of intricate molded parts. The present invention provides an inexpensive device which requires no injection molded parts. The nozzle assembly of this invention does not readily leak and the liquid reservoir or cartridge assembly which contains liquid soap can be susbstituted for the liquid reservoir or cartridge assembly in the SANI-FRESH device.

SUMMARY OF THE INVENTION

Briefly described, the present invention includes a main housing assembly which has a flat upright back plate provided in its central portion with a U-shaped outwardly extending bracket. A front casing is hingedly secured by a bottom hinge to the back plate and is frictionally held in place closed against the front of the back plate by an upper friction latch.

Within the interior of the assembly, in the cavity formed by the back plate and the front panel of the front casing is a liquid soap cartridge assembly having a liquid soap reservoir formed by an interior box-like fiberboard housing which contains a flexible, laminated liquid containing bag. One corner of this liquid containing bag receives a discharge tube, the end portion of the bag being clamped by a clamp therearound. The lower end of this discharge tube is externally threaded and selectively receives either a cup for storage or an internally threaded collar which removeably mounts a discharge nozzle thereto.

The discharge nozzle includes a resilient, flexible, elastomeric, tubular body, the upper and lower ends of which are provided respectively with an upper ball check valve assembly and a lower ball check valve assembly. The upper ball check valve assembly is normally open and includes a freely moveable ball within a tube in one end of the body, the ball resting upwardly against the seat formed by a smaller tube. Normally, however, it remains open by gravity, the ball being retained in place by a foraminous retainer. The tube protrudes through an internally threaded collar removeably received on the discharge tube of the liquid soap cartridge.

The lower ball check valve assembly includes an outer plastic tube which forms the body of the valve and a pair of spaced opposed inner tubes which are respectively received in the end portions of the outer tubes. A spherical seat formed in the upper inner tube in the shape of the ball, receives the ball which is spring urged against the seat by a helical spring, the lower end of which abuts the upper end of the lower inner tube. The lower ball check valve assembly is received in the lower end of the nozzle body.

Upper and lower clamps mounted on the central bracket removeably hold the nozzle assembly in place while a plunger carried by the front panel of the outer casing is adapted to depress the central portion of the body of the nozzle when the plunger is depressed.

Also part of the inventive concept is the process of forming a valve seat on the lower end of the upper inner tube of the lower ball check valve assembly by means of a heated metal ball which is heated to a prescribed temperature and then dropped into the inverted body of the valve so as to rest against the inner end of the thermoplastic inner tube for a sufficient time that the end of this inner tube is caused to be deformed to a spherical shape conforming to the shape of the ball. This heated ball is then removed and replaced by a teflon coated lower ball.

A second process includes first forming the flexible laminated bag, then cutting off one corner thereof and inserting the bag on the end of the discharge tube. A portion of the bag is then gathered around the upper portion of the discharge tube and a clamp is clamped around this gathered portion. Thereafter the portion of the bag which protrudes below the clamp is flaired out, being severed if desired so as to thereafter be glued in place on the bottom flap of the fiberboard housing with the tube protruding through the flap. The liquid reservoir is then inverted and the bag filled through the discharge tube. The discharge tube is then capped so that the liquid reservoir, thus formed, can be shipped as a unit.

According, it is an object of the present invention to provide a liquid dispenser which is inexpensive to manufacture, durable in structure and efficient in operation.

Another object of the present invention is to provide a liquid dispenser which does not readily leak.

Another object of the present invention is to provide a liquid dispenser which will dispense a measured amount of liquid when a plunger is fully depressed.

Another object of the present invention is to provide a liquid dispenser which will dispense progressively liquid as a plunger is depressed.

Another object of the present invention is to provide a liquid dispenser having a cartridge assembly which can be readily and easily replaced.

Another object of the present invention is to provide in a liquid dispenser, a discharge nozzle assembly which does not need to be replaced each time a new cartridge assembly is installed.

Another object of the present invention is to provide a liquid soap dispenser which has inexpensive liquid reservoirs which can be replaced therein periodically so as to provide new supplies of liquid soap.

Another object of the present invention is to provide a liquid dispenser in which the liquid reservoir can be readily and easily be replaced.

Another object of the present invention is to provide an inexpensive process of producing a valve seat.

Another object of the present invention is to provide a process of inexpensively producing a replacement cartridge for a liquid dispenser.

Other objects, features and advantages of the present invention will become apparent from the following description when taken in conjunction with the accompanying drawings.

DESCRIPTION OF THE PREFERRED EMBODIMENTS

Figure 1:
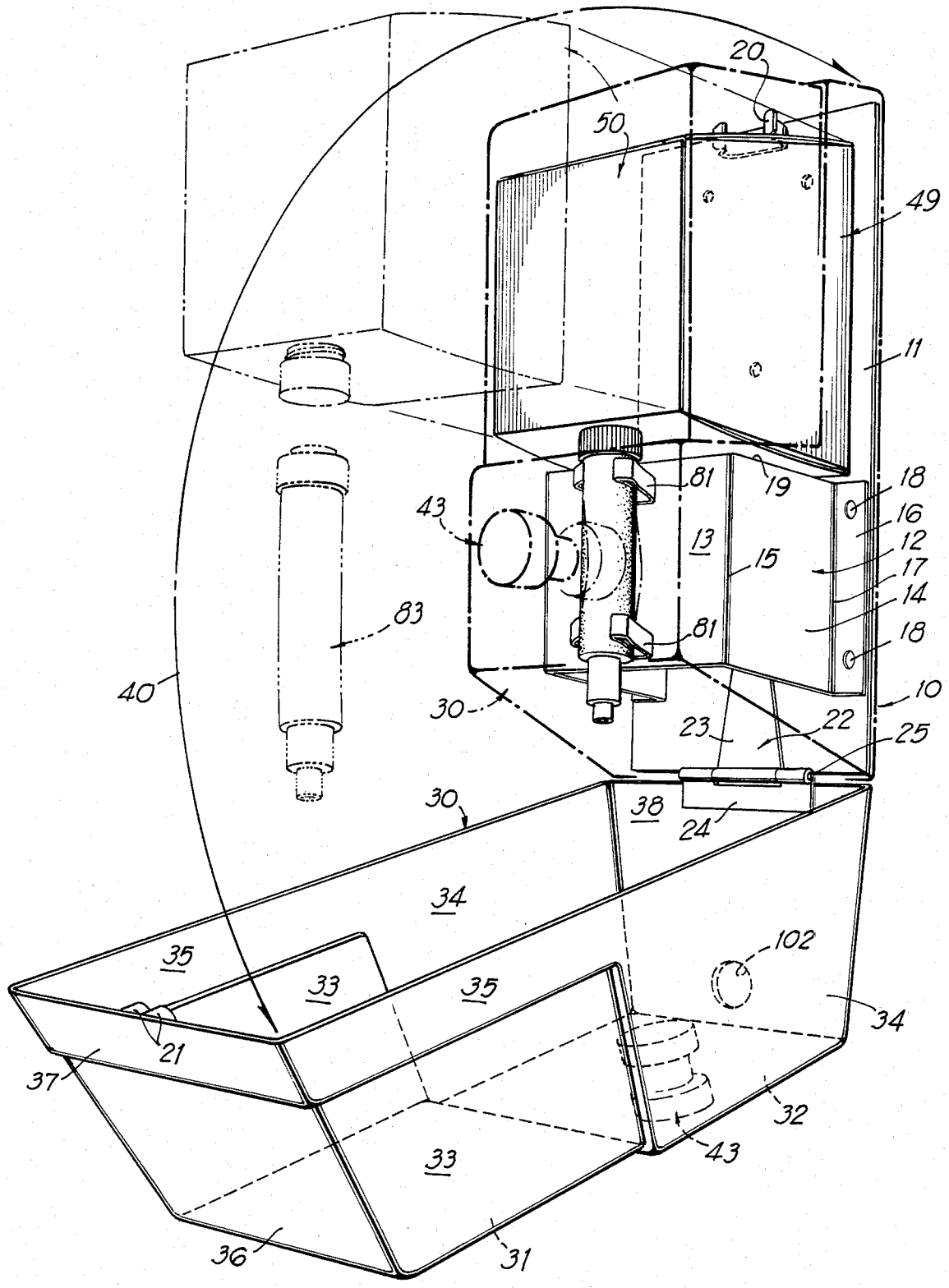
FIG. 1 is a perspective view of a liquid dispenser constructed in accordance with the present invention, the front casing being shown in its open position with the cartridge assembly installed, the cartridge assembly being shown in broken lines prior to its being installed.

Referring now in detail to the embodiment chosen for the purpose of illustrating the present invention, numeral 10 denotes generally the main housing assembly which comprises a flat rectangular metal back plate 11 provided on its front surface with a forwardly protruding, U-shaped, cartridge assembly supporting bracket 12. This supporting bracket 12 includes a flat rectangular front plate 13, a pair of spaced, opposed, parallel side plates 14 integrally joined by their forward edges to the outer edges of the front plate 13 along corners 15 and a pair of outwardly protruding flanges 16 which are integrally joined to the inner edges of the side plates 14 along common edges 17. The flanges 16 are in a common vertical plane spaced inwardly from and parallel to the flat rectangular front plate 13. Spot welds 18 secure the flanges 16 to the front surface of the back plate 11. The bracket 12 is in the lower central portion of the back plate 11 and has a horizontally disposed upper edge 19.

At the upper end portion of the back plate 11 there is a U-shaped resilient frictional clamp 20 which receives the spaced, opposed rollers 21 for forming a frictional latch.

At the lower end portion of the back plate 11, there is a hinge 22. In more detail, the hinge 22 includes a hinge plate 23 secured flat against the front central surface of the back plate 11. This hinge plate 23 is hingedly secured to a second hinge plate 24 by means of a hinge pin 25. The hinge pin 25 extends horizontally across the lower edge portion of the back plate 11.

The hinge plate 24 carries a molded plastic front casing, denoted generally by the numeral 30. This front casing 30 includes a front panel formed of an upper panel member 31 and a lower panel member 32, the upper panel member 31 being offset slightly inwardly of the lower panel member 32.

The front casing 30 also includes a pair of opposed side panels connected to the edges of the front panels, each side panel including an upper forward side panel member 33 and a lower side panel member 34, the upper side panel member 33 being offset inwardly with respect to the side panel member 34. There is also a back side panel member 35 which is rearwardly of the upper side panel member 33 and is co-planar with the lower side panel member 34. The upper edges of the side panel members 33 and front panel member 31 are joined by a forwardly and downwardly inclined top panel member 36 which, with a rear top panel member 37, forms the top panel of the casing 30.

The casing 30 also has a lower forwardly and upwardly inclined bottom panel 38 which joins the bottom edges of the side panel members 34 and the front panel members 32. The hinge plate 24 is secured along the inner surface of the bottom panel 38 while the rollers 21 are secured to the top panel member 37.

It is now seen that the front casing 30 is a plastic member preferably formed by vacuum molding and it has an open interior. When the casing 30 is pivoted upwardly, as indicated by the arrow 40, the rollers 21 secured to the inner upper edge of panel 37, are received in the latch 20 so that the front casing 30 forms a closure with the back plate 11. The latch 20 frictionally holds the rollers 21 so that the cover or casing 30 can be readily opened, if desired.

Figure 2:
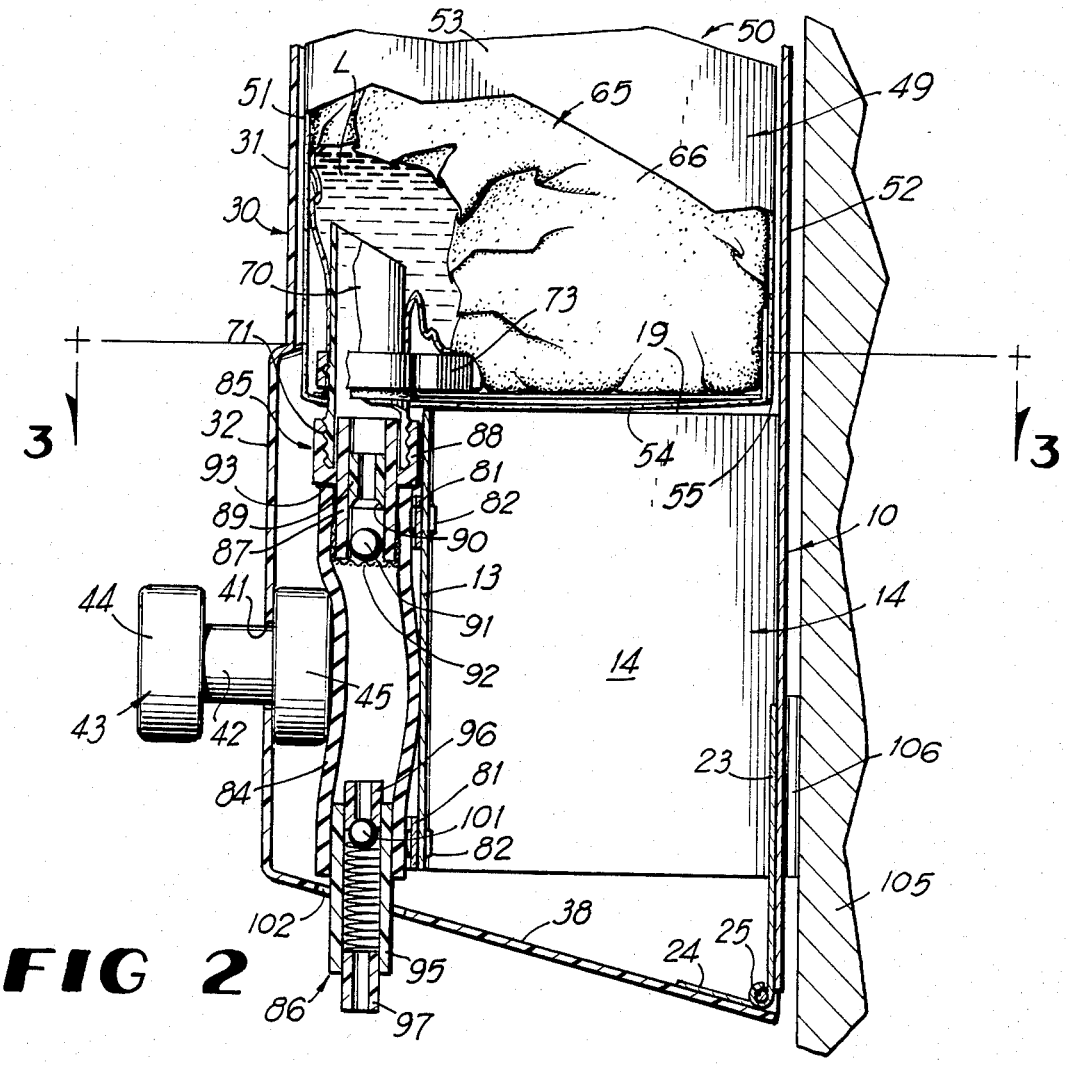
FIG. 2 is a vertical sectional view of the liquid dispenser depicted in FIG. 1, the dispenser being installed on a vertical wall of a building.

When casing 30 is closed against the back plate 10, the bottom front panel member 32 is disposed parallel to and spaced forwardly of the front plate 13, as seen in FIG. 2. The panel member 32 is provided with a central hole which loosely receives the cylindrical body 42 of a plunger, denoted generally by the numeral 43. The plunger 43 has an outer actuator nob 44 on one end of the body 42 and an inner, tube depressing member 45. The members 44 and 45 are preferrably cylindrical members of a diameter larger than the diameter of the body 42. The plunger 43 is formed in two parts and glued together so that, once installed, it remains at all times on the panel member 32 but is readily moveable rearwardly and forwardly, the members 44 and 45 limiting the movement of the plunger 43.

Within the upper portion of the main housing assembly, above the upper edge 19 of the bracket 12, there is a liquid soap reservoir, denoted generally by the numeral 50. The liquid reservoir 50 includes a relatively rigid fiberboard or cardboard housing 49 which conforms generally to the shape of the upper cavity defined by the panel members 31, 33, 36 and the upper portion of the back plate 11. This fiberboard housing 49 is a box-like member formed of vertically disposed front and back rectangular panels 51 and 52 and opposed parallel side panels 53 which join the edges of the front and back panels 51 and 52. The lower end of this fiberboard housing 49 is closed by a lower hinged flap 54 secured to the lower edge of the front panel 51 along a score line or hinge line 55. The flap 54 extends rearwardly across the bottom of the housing 49 and is provided with a forward tongue 56, seen in FIG. 7. The lower edges of the side panels 53 are provided with triangular flaps 57 which fold inwardly above the flap 54 and the tongue 56 is tucked between the leading edges of these flaps 57 and the front panel 51. The flap 54, when closed is perpendicular to the panels 51, 52 and 53, closing the bottom of housing 49.

The upper end of housing 49 is closed by an inclined flap 58 having a tongue 59 which fold over side flaps 60. The top flap 58 is secured along a hinge line 61 to the top edge of panel 51 and when in its closed position, the tongue 59 protrudes inside of the box thus formed adjacent to the front panel 51.

Since the back panel 52 is longer than the front panel 51, the top flap 58 extends forwardly and downwardly at an incline with respect thereto and conforms to the incline of the panel member 36.

Figure 4:
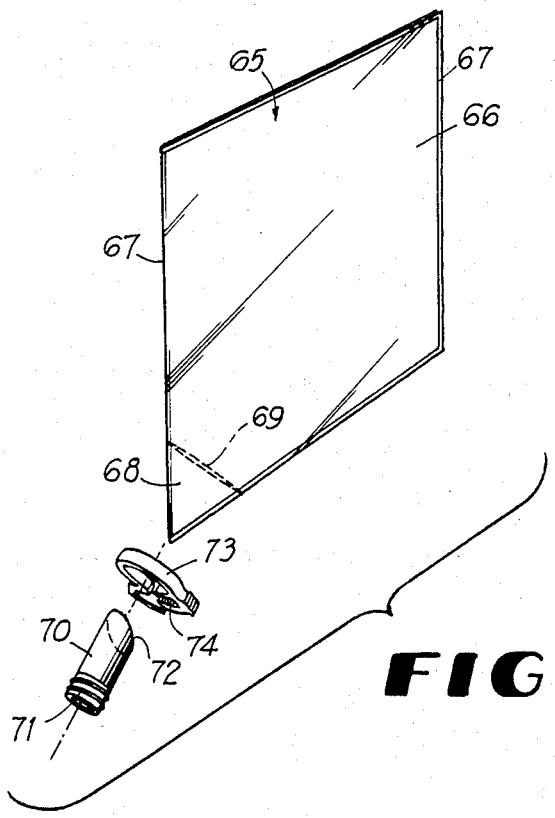
FIG. 4 is a perspective view showing a step in the formation of the cartridge assembly of the present invention in which the flexible laminated plastic bag, has a corner thereof cut off, in broken lines showing where the cut is made.

Within the hollow interior of the housing 49 there is an extruded high density polyethylene bag 65 made with 15% butyl rubber, formed of a single rectangular sheet of this plastic material, the sheet being reversely bent so as to form generally square or rectangular, opposed, parallel sides, such as side 66, which is heat sealed as at strips 67 along three edges and integrally joined along a common edge. This flexible bag 65 after being formed, has one corner 68 cut off diagonally as shown in FIG. 4 so as to provide a corner opening 69 which is larger than the outside diameter of a discharge tube 70. This discharge tube 70 has an externally threaded lower end 71 and an upper end 72 which is cut off at an incline to the axis of the tube so that, when the bag is assembled, the lower portion of the end 71 will be relatively close to the bottom formed by the bag 65.

Figure 5:
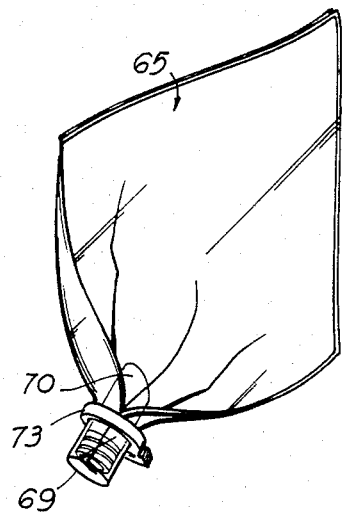
FIG. 5 is a perspective view similar to FIG. 4 but showing the assembly of the discharge tube on the flexible bag.

FIGS. 4, 5, 6, 7, 8 and 9 show the progressive assembly of the bag 65 and the discharge tube 70 and its subsequent filling. Referring to these figures, it will be seen that when the opening 69 is formed, the discharge tube 70 is inserted fully within the opening 69 so that the mouth of the opening 69 is outwardly of the threaded end 71, as seen in FIG. 5. Thereafter, the edge portions of the bag 65, adjacent to the tube 70, are overlapped over each other, as seen in FIG. 5, and a clamp 73 having a takeup ratchet 74 thereon is passed around the central portion of the tube and that portion of the bag which is adjacent thereto, also is illustrated in FIG. 5. When the clamp 73 is tightened therearound, the bag 65 is quite firmly held in place on the discharge tube 70.

Figure 6:
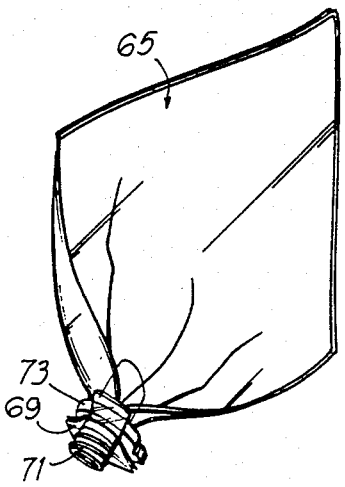
FIG. 6 is a view similar to FIG. 5 and shows the progressive assembly of the bag and discharge tube.
Figure 7:
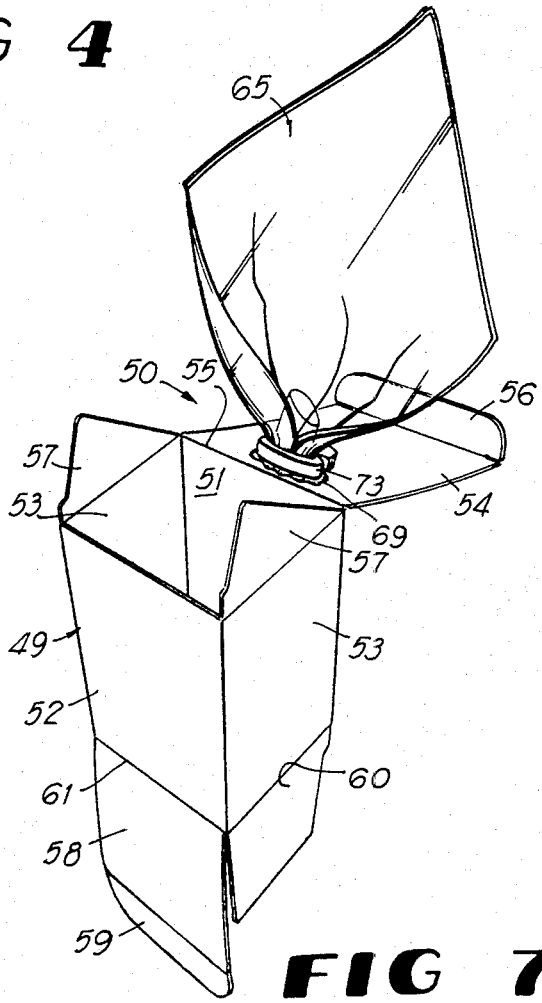
FIG. 7 is a perspective view of the assembled flexible bag, discharge nozzle and clamp assembled with the interior fiberboard housing.

Thereafter, the bag 65 at the opening 69 is cut longitudinally usually at about 120° from each other and that portion of the bag 65 which protrudes below the clamp 73 is flaired out, as depicted in FIG. 6. Then the outer portion of the discharge tube 70 is inserted through a hole in flap 54 adjacent to hinge line 55 and glue is applied so that the protruding portion of the bag is confined between the clamp 73 and the inner surface of the flap 54 as depicted in FIG. 7.

Figure 8:
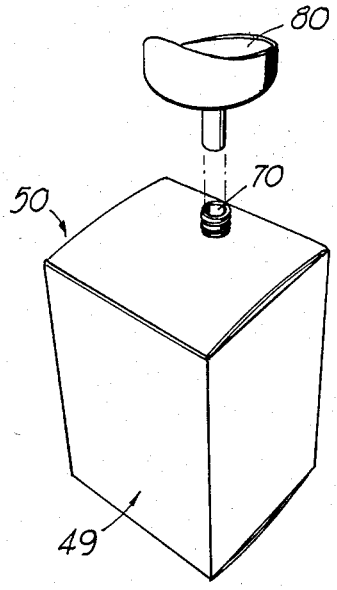
FIG. 8 is a perspective view of the assembled liquid reservoir depicting the reservoir being filled with liquid, particularly soap.
Figure 9:
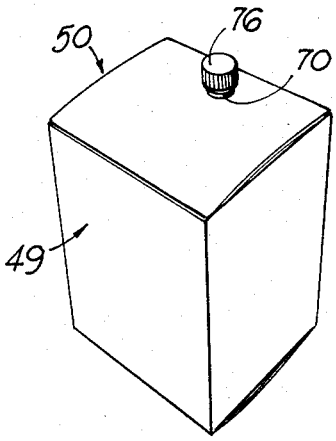
FIG. 9 is a view of the liquid reservoir depicted in FIG. 8 but the nozzle being capped after it has been filled.

Next, the bag 65 is inserted into the interior formed by the panels 51, 52 and 53, and the flap 54 is closed as previously described. Also the flap 58 is closed as previously described. This forms a liquid reservoir 50 as seen in FIG. 8. Next a nozzle of the liquid soap filling member 80 is inserted into the discharge tube 70 and liquid, such as liquid soap, is filled into the bag 65. The bag 65 thus fills out being confined by the panels 51, 52 and 53. A threaded cap 76 is installed on the threaded end 71 of the tube 70 to form the liquid reservoir 50 shown in FIG. 9.

When the reservoir 50 is installed in the main housing assembly 10, the discharge tube 70 is forwardly of the vertical plate 13 and rearwardly of the panel 32 and protrudes downwardly a short distance in front of the plate 13. Below the threaded end 71 of the tube 70 and in vertical alignment therewith are a pair of nozzle supporting brackets 81 which are secured by means of brads 82 to the front plate 13. These brackets 81 are U-shaped spring members which yieldably receive the nozzle assembly, denoted generally by the numeral 83. The function of this nozzle assembly 83 is to meter the amount of liquid being discharged by the liquid dispenser. Normally, about 1½ cc's of soap liquid is to be discharged each time the plunger 43 is depressed. Of course, this amount may be varied, as desired.

The nozzle assembly 83 includes a central elastomeric flexible resilient latex, dispenser tube 84 open at both ends and extending from a position slightly below the lower end of the discharge tube 70 to a position slightly below the lower edge of the plate 13. The tube 84 is provided at its upper end with a normally open ball check valve assembly 85 and at its lower end with a normally closed ball check valve assembly 86.

The upper ball check valve assembly 85 comprises an outer relatively rigid length of plastic acrylic tube 87, this plastic outer tube 87 forming the body member and being secured in a central hole in an internally threaded polyethylene screw cap 88. Within the central portion of the body member or tube 87 is another rigid vinyl tube plastic tube 89 which is shorter than the outer tube 87, this inner tube 89 having a valve seat 90 on its lower end.

Below the seat 90 and loosely received in the tube 87 is a plastic ball 91 which is formed of an acrylic plastic material. The lower end of the tube 87 is closed by a foraminous, flexible, retainer 92. This retainer 92 is preferably formed of a thin plastic screen or mesh which is fitted over the lower end of the tube 87, the retainer 92 being of larger diameter than the tube 87 so that its outer peripheral portions are gathered upwardly around the body of the tube 87. The retainer or strainer 92 is inserted with the end of tube 87 into dispenser tube 84. The latex dispenser tube 84 then fits over this outer peripheral area of the retainer 92, when tube 87 is inserted fully into tube 84, the end of tube 84 terminates with its upper end against a serrated peripheral area 93 of the cap 88. Cycaocylic adhesive or glue secures the body 84 to the lower end portion of the tube 87 with the retainer 92 serving to hold the glue in place. The serrations 93 on the cap 88 engage the upper edge of the dispenser tube 84 so that it cooperates with the glue in preventing rotation of the cap 88 with respect to the tube 84, even when the tube 84 is employed to rotate the cap 88.

When the nozzle is to be installed, the cap 88 is received by its internal threads on the end of the discharge tube 70, the external thread 71.

The lower ball check valve assembly 86 includes a length of relatively rigid vinyl plastic tube 95, the ends of which receive short lengths of smaller relatively rigid vinyl plastic tubes which form the upper valve seat member 96 and the lower discharge member 97. The outside diameter of these tubes or members 96 and 97 are approximately equal to the inside diameter of the tube 95 which form the body of the valve assembly 86.

Figure 11:
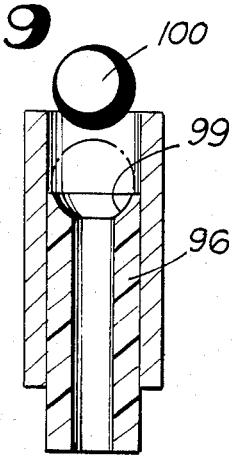
FIG. 11 is a schematic view depicting the formation of the seat of the lower ball check valve assembly.
Figure 10:
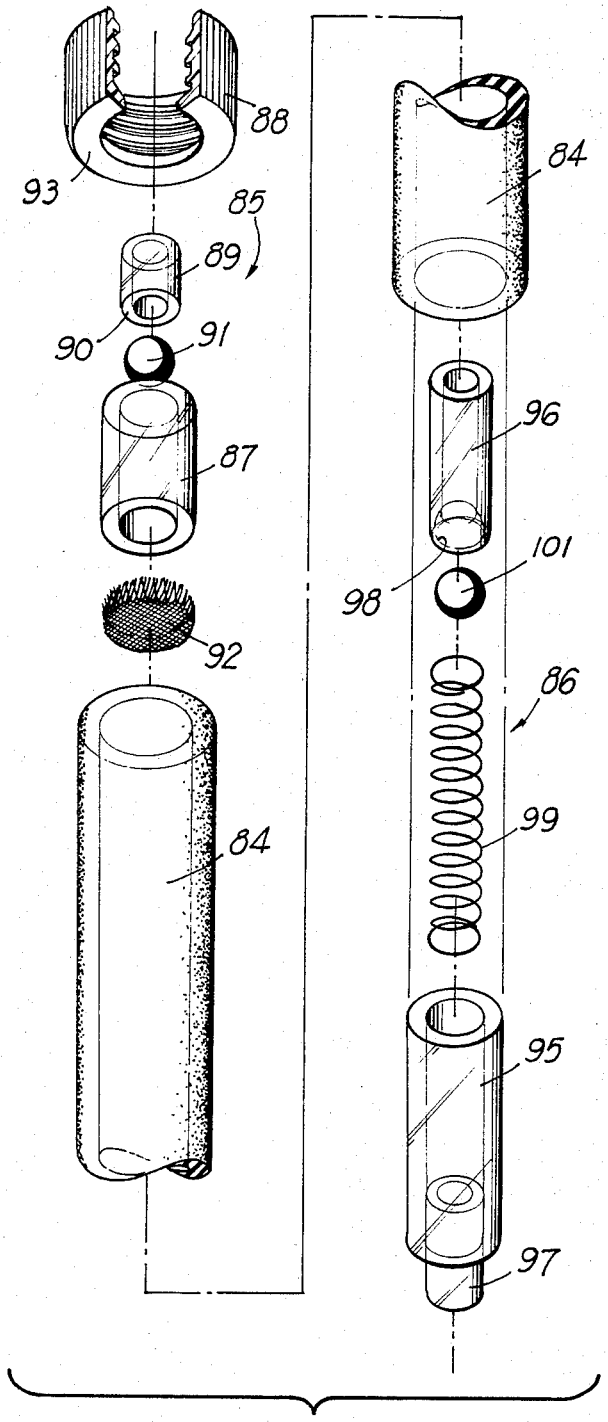
FIG. 10 is an exploded perspective view of the two ball check valve assemblies of the discharge nozzle.

The valve seat tube 96, as depicted in FIG. 11 is provided with a valve seat 98 formed, after the inner tube 96 has been inserted into the upper end portion of the larger body tube 95. This valve seat 98 is formed by a heated steel ball 100 which is of a diameter equal to the diameter of a ball 101 which forms a portion of the ball check valve assembly. Which, after being heated to a temperature of between 140° and 160° F., is dropped onto the inner end of the inverted tube 96 in tube 95 so that ball 100 heats the end sufficiently that the end is deformed to the contour of the ball 100.

Thereafter, the ball is dumped out of the tube 95. When the ball 100 is dumped out, the ball 101, which is a teflon coated steel ball, is substituted therefor, the balls 100 and 101 being of identical diameter.

A coil spring is inserted into the tube 95, the coil spring being of a length greater than the distance between the ends of the tubes 96 and 97, whereby the spring 99 is placed under compression urging the ball 101 onto its seat 98. Preferably, the tubes 96 and 97 protrude from the tube 95 and their inner portions are glued in place within the inner end portions of the tube 95. Thereafter, the end portion of the tube 95 is inserted and glued into the inner end portion of the body 84.

The overlapped portions of the tubes 87 and 84 at the upper end portion and tubes 96, 95 and 84 at the lower portion of the nozzle assembly 83 provide relatively rigid end portions which are respectively removeably received by the spring clips 81, as seen in FIG. 2.

Figure 3:
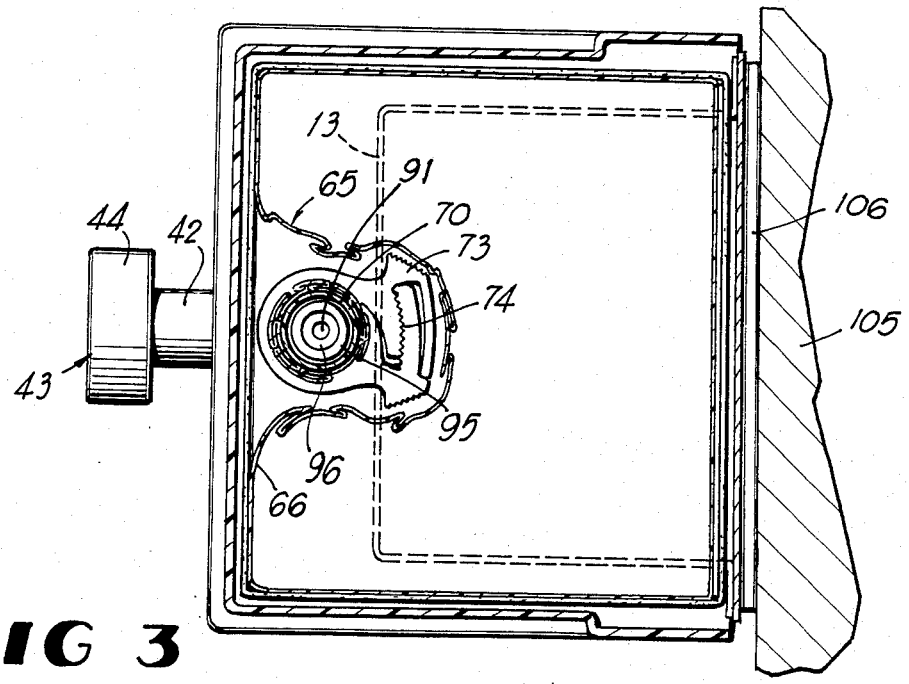
FIG. 3 is a cross-sectional view taken substantially along line 3—3 in FIG. 2.

It is now seen that the nozzle assembly 83 can be quite readily installed on and removed from the liquid reservoir 50 by simply removing the cap 76 from the reservoir 50 and installing the cap 88 of the upper ball check valve assembly 85 in its place. The tube 87 is of an outside diameter smaller than the inside diameter of the discharge tube 70 and therefore readily fits inside the lower end portion thereof when the cap 88 is threaded onto the threads 71 of the discharge tube 70. When the reservoir 50 is installed on the upper edge 19 of the bracket 14, the nozzle assembly 83 is disposed in front of the plate 13 so that the clips 81 receive the nozzle assembly 83 as illustrated in FIG. 1. Thus, the nozzle assembly 83 is supported with the axes of the various concentric tubes in a vertical position and the central portion of dispenser tube 84 disposed in front of the disc shaped tube depressing member 45 of the plunger 43. The lower end of nozzle assembly 83 protrudes out of a hole 102 in the bottom panel 38. The liquid dispenser is installed in a conventional manner on a vertical wall 105 by means of pressure sensitive adhesive strips, such as strip 106 seen in FIG. 2 and FIG. 3.

Each time the plunger 43 is moved rearwardly, it squeezes and flattens the central portion of dispenser tube 84 against the base 13 so that the volume of tube 84 is decreased and liquid in the tube 84 lifts the ball 91 of check valve 85, seating it against the seat 90. With further depression or squeezing of the tube 84, the liquid lifts the ball 101 away from its seat 98 on tube 96 and therefore permits the discharge of the liquid, i.e., liquid soap out of the lower end of the tube 97.

When the plunger 43 is released, the resiliency of the tube 84 is sufficient to return it to its original generally circular condition and return the plunger 43 to the position shown in FIG. 2. When pressure is relieved on the tube 84, the spring 99 returns the ball 101 to its original seated condition on seat 98. With further return to its original circular condition, the tube 84 tends to create a vacuum which draws the ball 91 to its open position and permits both the weight of the liquid L in the bag 65 and the partial vacuum in the tube 84 to cause the tube 84 to draw in additional liquid L so as to fill the area of tube 84 between the two ball check valves 85 and 86.

When all of the liquid L has been dispensed, the liquid reservoir 50 is removed from the nozzle assembly 83 and a new liquid reservoir 50 is installed thereon as described above. Of course, in order to remove the liquid reservoir 50, the front casing 30 is pivoted downwardly to the position shown in FIG. 1 and both the nozzle assembly 83 and the reservoir 50 are removed. Thereafter, the nozzle assembly 83 is removed from the empty reservoir 50 and installed on a new reservoir by removing the cap 76 therefrom. Of course, the reservoir 50 should be in an inverted position when this is accomplished. Thereafter, both the new reservoir 50 and the old original nozzle 83 may be installed and reinstalled respectively.

It will be obvious to those skilled in the art that many variations may be made in the embodiment here chosen for the purpose of illustrating the present invention without departing from the scope thereof as defined by the appended claims.

I claim:

1. A cartridge assembly for use within a liquid dispenser comprising:

(a) a box-like fiberboard housing having a hole in its bottom portion;

(b) a flexible bag within said housing; said bag having a corner and an opening provided at said corner;

(c) liquid within said bag for being dispensed from said cartridge assembly;

(d) a discharge tube having an intermediate portion and an inner portion protruding through said opening and received within said bag, said bag being gathered around said intermediate portion said tube having an outer end portion;

(e) a compression clamp surrounding a portion of the gathered portion of said bag and said intermediate portion of said tube, the outer portion of said gathered portion extending below said clamp;

(f) adhesive means for securing said outer portion of said gathered portion of said bag between the inner surface of said housing and said clamp, said outer end portion of said tube protruding out of said opening in said housing; and (g) a ball check valve extending through a hole in a screw cap and communicating with the interior of said tube, a flexible dispensing tube secured to said ball check valve, and a second ball check valve on the end of said dispensing tube, said first mentioned ball check valve being normally open and said second ball check valve being normally closed.

2. The cartridge assembly defined in claim 1 wherein said second ball check valve includes a body tube forming the body of said second ball check valve and a pair of spaced opposed smaller tubes within the ends of said body tube, a ball within said body tube and seating against one end of one of said smaller tubes and a spring member for urging said ball into seating engagement with said one of said smaller tubes.

3. The cartridge assembly defined in claim 1 wherein said first mentioned ball check valve includes a body tube received concentrically in and extending through said cap, a valve seat tube within said body tube, a ball moveable within the body tube for seating against said ball seat tube and retainer means on the end of said tube for retaining said ball within said body tube.

4. A cartridge assembly for use with a liquid dispenser, said cartridge assembly being of the type having a fiberboard housing and a flexible bag containing liquid disposed within said housing wherein the improvement comprises: A discharge tube connected to said bag, said discharge tube communicating with the interior of said bag for discharging liquid from said bag, said discharge tube protruding through a hole in said housing, adhesive means securing said discharge tube in place with respect to said housing, a removable cap on the discharge end of said discharge tube; and a nozzle assembly on the end of said discharge tube, said nozzle assembly including a body tube extending through said cap and into said discharge tube, a valve seat within said body tube, a ball within said body tube for seating against said valve seat, a retainer at the lower end of said cap for retaining said ball within said body tube, a dispensing tube connected by one end to said ball check valve, and a second ball check valve on the end of said dispensing tube.

5. A liquid dispenser comprising a main housing assembly having a back plate and a front casing defining a hollow interior, a bracket mounted on said back plate and extending forwardly therefrom within said front casing said bracket having an upper surface and a front surface, said front surface being spaced from a front portion of said front casing, a liquid reservoir having liquid therein, carried by the upper surface of said bracket, a discharge tube communicating with the liquid in said reservoir, the outer end of said discharge tube being provided with external threads, a nozzle assembly having a cap at one end, said cap being threadedly secured to the threaded end of said discharge tube, said discharge nozzle being disposed between said front surface of said bracket and the front portion of said front casing, said discharge nozzle having a resilient, flexible dispensing tube and a pair of ball check valves at the ends of said dispensing tube, the upper ball check valve being normally open and the lower ball check valve being normally closed, and a plunger moveably carried by said front casing, said plunger being positioned in front of said dispensing tube of said nozzle when said front casing is closed against said back plate, said plunger being moveable to squeeze said body for urging the liquid in said body toward both ends thereof for closing the upper ball check valve and opening the lower ball check valve to permit discharge of the liquid through the lower ball check valve and out of the end of the discharge nozzle, said dispensing tube being sufficiently resilient that, when the plunger is released, the dispensing tube will assume its original contour, thereby drawing in additional liquid via the upper ball check valve from said bag.

6. The liquid dispenser defined in claim 5 wherein said upper ball check valve includes a pair of concentric larger and smaller tubes, the smaller tube being within the upper end of the larger tube, a ball within said larger tube and an open mesh member across the lower end of said larger tube.

7. The liquid dispenser defined in claim 6 wherein said lower ball check valve includes a larger tube and a pair of spaced upper and lower smaller tubes within the ends of said larger tube, a ball within said larger tube for closing said upper smaller tube and a spring within said larger tube for urging said ball into a seated position against the end of said upper smaller tube.

8. The liquid dispenser defined in claim 7 wherein said spring is a coiled spring, the lower end of which acts against said lower smaller tube.

9. The dispenser defined in claim 5 wherein said reservoir includes a housing and flexible rectangular bag within said housing, and a discharge tube protruding through one corner portion of said bag, said discharge tube being removeably connected to the upper end of said nozzle assembly.

* * * * *